US006425368B1

(12) United States Patent
Lambert

(10) Patent No.: US 6,425,368 B1
(45) Date of Patent: Jul. 30, 2002

(54) FUEL INJECTOR

(75) Inventor: Malcolm David Dick Lambert, Bromley (GB)

(73) Assignee: Delphi Technologies, Inc., Troy, MI (US)

( * ) Notice: Subject to any disclaimer, the term of this patent is extended or adjusted under 35 U.S.C. 154(b) by 31 days.

(21) Appl. No.: 09/599,221

(22) Filed: Jun. 22, 2000

(30) Foreign Application Priority Data

Jun. 24, 1999 (GB) ..... 9914646

(51) Int. Cl.[7] ..... F02B 3/00
(52) U.S. Cl. ..... 123/300; 123/467
(58) Field of Search ..... 123/299, 300, 123/467, 498; 239/88–96; 137/625.65

(56) References Cited

U.S. PATENT DOCUMENTS 3,391,680 A * 7/1968 Benson ..... 123/498
4,022,165 A * 5/1977 Eckert et al. ..... 123/300
4,175,587 A * 11/1979 Chadwick et al. ..... 137/625.65
4,546,739 A * 10/1985 Nakajima et al. ..... 123/299
4,736,712 A * 4/1988 Savkar et al. ..... 123/23
5,163,397 A * 11/1992 Pien ..... 123/299
5,315,973 A * 5/1994 Hill et al. ..... 123/304
5,551,634 A * 9/1996 Raab et al. ..... 239/96
5,862,793 A * 1/1999 Jay et al. ..... 123/467
6,152,111 A * 11/2000 Potz et al. ..... 123/467

* cited by examiner

*Primary Examiner*—Carl S. Miller
(74) *Attorney, Agent, or Firm*—Thomas N. Twomey

(57) ABSTRACT

A fuel injector of the outwardly opening type comprising a nozzle body provided with a first bore, a valve needle slidable within the bore and engageable with a seating to control the supply of fuel from the bore, first and second control chambers for receiving fuel under pressure and a control valve arrangement for controlling the fuel pressure within the first and second control chambers. The valve needle is moveable in response to a change in fuel pressure in at least one of the first and second control chambers.

9 Claims, 2 Drawing Sheets

FUEL INJECTOR

TECHNICAL FIELD

The invention relates to a fuel injector for use in supplying fuel, under pressure, to a combustion space of a compression ignition internal combustion engine. In particular, the invention relates to a fuel injector of the outwardly opening type.

BACKGROUND OF THE INVENTION

Known fuel injectors of the outwardly opening type include a valve needle, slidable within a bore and engageable with a seating to control the supply of fuel from the bore. The valve needle is moved outwardly of the bore to move the needle away from its seating under the control of a piezoelectric actuator. The distance through which the valve needle is moved is typically controlled by controlling the energization level, and hence the axial length, of a piezoelectric stack. Such an actuation technique is thought to be undesirable as piezoelectric stacks of dimensions suitable for use in such applications are relatively expensive and can be difficult to control.

It is an object of the present invention to provide a fuel injector of the outwardly opening type in which the distance moved by the valve needle can be controlled by alternative means.

SUMMARY OF THE INVENTION

According to the present invention, there is provided a fuel injector of the outwardly opening type comprising a nozzle body provided with a first bore, a valve needle slidable within the bore and engageable with a seating to control the supply of fuel from the bore, first and second control chambers for receiving fuel under pressure and control valve means for controlling the fuel pressure within the first and second control chambers, the valve needle being moveable in response to a change in fuel pressure in at least one of the first and second control chambers.

The fuel injector of the present invention therefore uses hydraulic means to control movement of the valve needle. The control valve means can therefore be operated conveniently by means of an electromagnetic actuator arrangement. The cost of the fuel injector is therefore reduced compared to fuel injectors in which valve needle movement is controlled by means of a piezoelectric actuator. Furthermore, it is easier to control movement of the valve needle with greater accuracy.

Alternatively, the control valve member may be operated by means of a piezoelectric actuator.

In one embodiment of the invention, the control valve means may include a single control valve member having first and second valve seatings, whereby movement of the control valve member away from the first valve seating only causes movement of the valve needle into a first fuel injecting position and movement of the control valve member away from both the first and second valve seatings causes movement of the valve needle into a second fuel injecting position.

The valve needle may include first and second fuel outlet passages axially spaced on the valve needle such that, when the valve needle is in the first fuel injecting position, fuel is only discharged through the first outlet passage and, when the valve needle is in the second fuel injecting position, fuel is also discharged through the second outlet passage. In this way, the rate of fuel injection into the engine can be carefully controlled.

Conveniently, the fuel injector includes a thrust member, moveable in response to a change in fuel pressure in at least one of the first and second control chambers, the thrust member acting on the valve needle to control valve needle movement.

The valve needle may be provided with further outlet passages and the control valve means may be arranged to control movement of the valve needle between first, second and further fuel injecting positions.

In an alternative embodiment, the control valve means may include two control valve members for controlling the fuel pressure within the first and second control chambers independently.

BRIEF DESCRIPTION OF THE DRAWINGS

The invention will now be described with reference to the following drawings, in which.

DESCRIPTION OF THE PREFERRED EMBODIMENT

Figure 1:
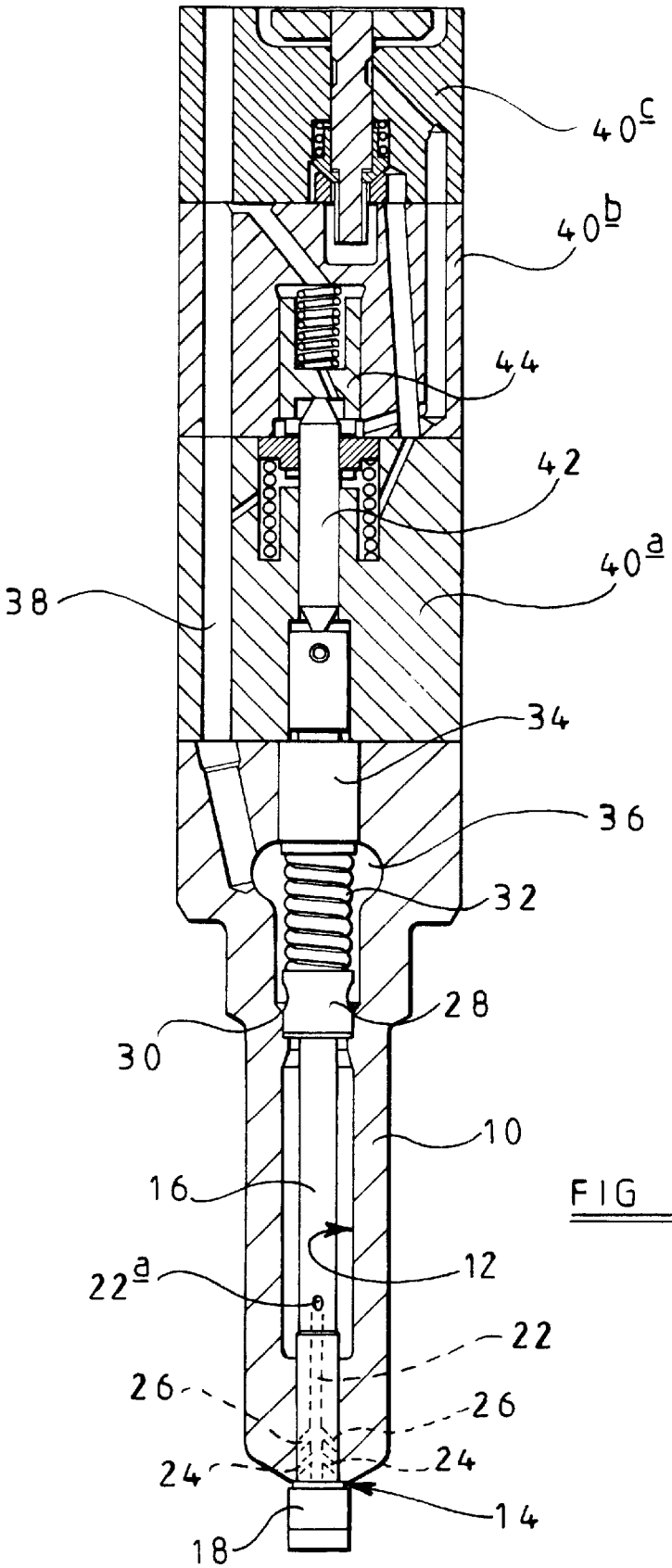
FIG. 1 is a sectional view of a fuel injector in accordance with an embodiment of the present invention.
Figure 2:
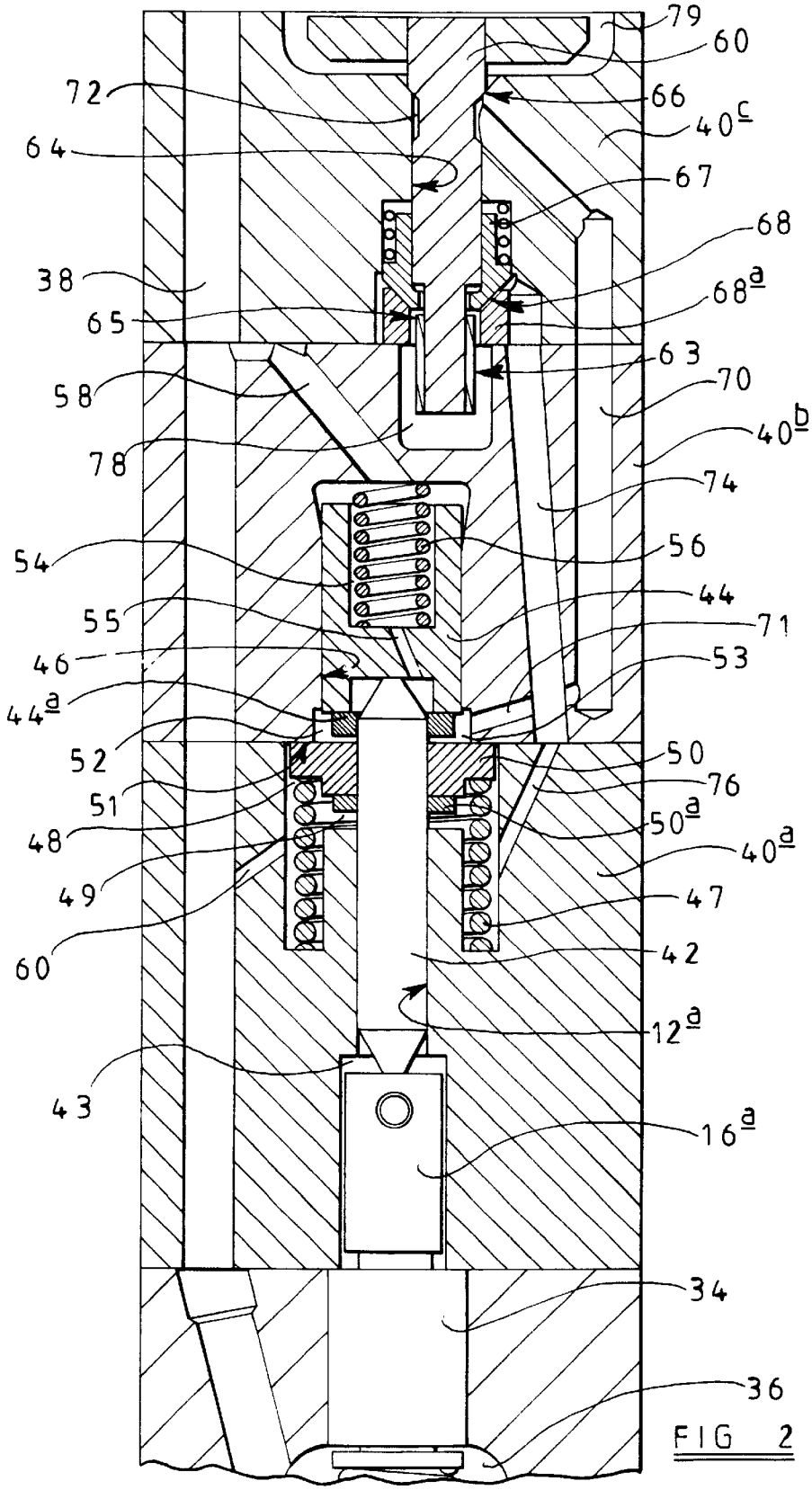
FIG. 2 is an enlarged sectional view of a part of the fuel injector shown in FIG. 1.

The injector illustrated in FIGS. 1 and 2 comprises a nozzle body 10 having a through bore 12 formed therein. The bore 12 is shaped, adjacent its lower end, to define a seating 14. A valve needle 16 is located within the bore 12, the needle 16 including, at its lower end, a region 18 of enlarged diameter which is engageable with the seating 14 to control the supply of fuel from the fuel injector. The valve needle 16 is provided with a central bore 22 (shown in dash lines) communicating, through a drilling 22*a*, with the bore 12 and with first and second outlet passages 24,26 (also shown in dash lines), the first and second outlet passages being axially spaced on the valve needle 16. Only two outlet passages are shown at each axial position, but additional outlet passage may also be provided at each axial position.

In use, fuel is supplied to the bore 12 from a suitable source of fuel under pressure, for example the common rail of a common rail fuel supply system. As the needle 16 moves downwardly away from the seating 14 by an initial, relatively small amount, the first outlet passages 24 are exposed and fuel ejects therefrom. As the needle moves downwardly by a further amount, the second outlet passages 26 become exposed and fuel also ejects therefrom. In this way, the rate of delivery of fuel can be controlled by controlling the extent of movement of the valve needle 16.

The upper end of the valve needle 16 is provided with a screw-thread formation (not shown) which engages a corresponding formation provided on the interior of a spring abutment member 34. The spring abutment member 34 takes the form of a cylindrical sleeve having an outer diameter slightly smaller than the diameter of the adjacent part of the bore 12. It will be appreciated that the engagement of the spring abutment member 34 with the corresponding adjacent part of the bore 12 and the engagement between the part of the needle 16, having the central bore 22, and the corresponding adjacent part of the bore 12 serves to guide the valve needle 16 for movement along the axis of the bore 12.

The bore 12 defines a step 30 with which a second spring abutment member 28 engages. A compression spring 32 is located between the spring abutment member 34 and the second spring abutment member 28 to bias the valve needle 16 in an upward direction and therefore to bias the enlarged part 18 of the valve needle 16 into engagement with the seating 14. The spring 32 is housed within a spring chamber 36 defined by an upper part of the bore 12. Fuel injector housing parts 40*a*,40*b*,40*c* and the nozzle body are provided with drillings to provide a supply passage 38 for fuel. The supply passage 38 provides fluid communication between a suitable source of fuel under pressure (not shown) to the spring chamber 36. The spring chamber 36 communicates with the bore 12 such that, in use, fuel under pressure can be supplied to the bore 12.

The upper end of the valve needle 16 engages a lower end of a thrust member 42, the other end of the thrust member 42 engaging a piston 44. The piston 44 is slidable within a bore 46 provided in the housing part 40*b*. The thrust member 42 extends centrally through a chamber 48 defined in the housing part 40*a* and is slidable within a bore 12*a* which is coaxial with the bore 12. An annular stop member 50 is housed within the chamber 48, the inner diameter of the stop member 50 being slightly larger than the diameter of the thrust member 42 such that the stop member 50 forms a close fit around the thrust member 42. A compression spring 47 is also housed within the chamber 48 and serves to bias the stop member 50 in an upwards direction against a seating 51 defined by a part of the lower end-face of the housing part 40*b*. When the stop member 50 is in its seated position, there is a substantially fluid tight seal between the housing part 40*b* and the stop member 50. The lower surface of the stop member 50 and the housing part 40*a* define a first clearance gap 49. The chamber 48 forms a first control chamber to which fuel is supplied from supply passage 38 through a drilling 60.

The diameter of the thrust member 42 is slightly smaller than the diameter of the adjacent part of the bore 12*a* such that the thrust member 42 fits closely within the bore 12*a*. As can be seen most clearly in FIG. 2, as the seal is formed between the stop member 50 and the housing part 40*b*, the stop member 50 need not be a close fit with the outer wall of the chamber 48, thereby simplifying manufacture.

A second control chamber 52 is defined by the housing part 40*b*, part of the thrust member 42, the lower end of the piston 44 and the upper surface of the stop member 50, the thrust member 42 extending centrally through the second control chamber 52 and engaging the piston 44. As can be seen most clearly in FIG. 2, the upper surface of the stop member 50 and the lowermost end of the piston 44 define a second clearance gap 53 within the second control chamber 52.

A chamber 54 is formed within the piston 44, the chamber 54 housing a compression spring 56 which serves to bias the piston 44 in a downwards direction. The chamber 54 communicates, via a drilling 58, with the supply passage 38. The chamber 54 also communicates with the second control chamber 52 by means of a narrow passage 55 provided by a drilling in the piston 44.

Movement of the piston 44 and the thrust member 42 is controlled by means of a control valve arrangement. The control valve arrangement includes a control valve member 62 slidably mounted within a bore 64 formed in the housing part 40*c*. The control valve member 62 is engageable with a first valve seating 66 defined by the bore 64. The second control chamber 52 communicates, via passages 71 and 70, with an annular chamber 72 defined by the bore 64 and a reduced diameter region of the control valve member 62. When the control valve member 62 is moved away from the first seating 66, fuel can flow from the second control chamber 52, through passages 71,70, into the annular chamber 72 and past the first seating 66 into chamber 79. Chamber 79 is connected to a low pressure fuel reservoir (not shown).

The control valve member 62 has a region of reduced diameter towards its lowermost end upon which a sleeve 63 is mounted defining a step 65. Upward movement of the control valve member 62 by a sufficient amount results in the step 65 engaging an annular collar member 67 surrounding the control valve member 62. The annular collar member 67 is arranged such that it seats against a second seating 68, defined by seating member 68*a* when the control valve member 62 is in its lowermost position. If the control valve member 62 is moved upwardly by only a small amount, the control valve member 62 lifts away from the first seating 66 but the annular collar member 67 remains seated against the second seating 68. A spring is provided to bias the annular collar member 67 towards the second seating 68. Further movement of the control valve member 62 in an upwards direction causes the step 65 to move into engagement with a lower surface of the annular collar member 67, thereby causing the annular collar member 67 to lift away from the second seating 68.

The first control chamber 48 communicates, via a narrow passage 76 provided in housing part 40*a*, with a passage 74 provided in housing parts 40*b*, 40*c*. Thus, when the annular collar member 67 is moved away from the second seating 68, fuel within the first control chamber 48 can flow through passages 76 and 74, past the second seating 68 and into a chamber 78. The chamber 78 is in communication with a low pressure fuel reservoir (not shown). The control valve arrangement is preferably actuated by means of an electromagnetic actuator arrangement, only the armature of which is shown. In use, fuel under pressure is supplied through the supply passage 38 to the bore 12. Prior to the commencement of fuel injection, the control valve member 62 is positioned such that it is seated against the first seating 66 and the annular collar member 67 is seated against the second seating 68. Fuel supplied through the supply passage 38 also flows into the chamber 54 and, thus, also into the second control chamber 52 via the inlet passage 55. Fuel also flows into the first control chamber 48 through the inlet passage 60. The nozzle body 10 and the valve needle 16 are appropriately dimensioned to ensure that, in these circumstances, fuel pressure within the bore 12 acts on the valve needle 16 in such a way that the valve needle 16 is biased in an upwards direction. The valve needle 16 is also biased in an upwards direction by means of the spring 32 in the spring chamber 36. The upward biasing of the valve needle 16 is countered by the force due to fuel pressure within the chamber 54.

In order to commence fuel injection, the control valve member 62 is operated, by the electromagnetic actuator, such that it moves in an upwards direction away from the first valve seat 66 by a small distance insufficient to move the annular collar member 67. Fuel within the second control chamber 52 therefore flows through passages 71,70, past the first valve seat 66 to low pressure. Fuel pressure within the second control chamber 52 drops, the passage 55 restricting the rate at which fuel can enter the second control chamber 52, and as a result the piston 44 moves in a downwards direction due to the force applied by fuel pressure in the chamber 54. The rate at which fuel flows from the second control chamber 52 is determined by the dimensions of the narrow passage 71. The movement of the piston 44 is transmitted through the thrust member 42 to the valve needle 16.

When the piston 44 has moved in a downwards direction by an amount equal to the clearance gap 53 it abuts the stop member 50. The fuel pressure within the first control chamber 48 is still high as the annular collar member 67 is seated against the second valve seat 68. Thus, although the piston 44 abuts the stop member 50 it does not provide sufficient force to overcome fuel pressure in the first control chamber 48 and to move the stop member 50 away from the seating 51. The movement of the valve needle 16 results in the enlarged region 18 thereof moving away from the seating 14 and the first outlet passages 24, but not the second outlet passages 26, are exposed causing fuel to be ejected from the first outlet passages 24 only. It will therefore be appreciated that fuel injection occurs at a relatively low rate.

In order to terminate fuel injection the control valve member 62 is moved back into a position where it is seated against the first valve seating 66. High fuel pressure is then re-established in the second control chamber 52 by fuel entering through the inlet passage 55, until the fuel pressure applied to the chamber 54 balances the fuel pressure within the second control chamber 52. The forces on the valve needle 16 then cause the valve needle 16 to return to the position illustrated, causing the enlarged region 18 to move back against the seating 14.

Alternatively, instead of terminating fuel injection, the control valve member 62 may be operated such that it moves in an upwards direction by a further amount sufficient to lift the annular collar member 67 from the second seating 68. As described previously, the pressure in the second control chamber 52 reduces as fuel flows through passages 71 and 70 and past the first seating 66. Additionally, fuel pressure in the first control chamber 48 is reduced as fuel flows through passages 76 and 74 past the second seating 68, the passage 60 limiting the rate at which fuel can enter the first control chamber 48. The rate at which fuel flows from the first control chamber 48 is determined by the dimensions of the narrow passage 76. In such circumstances, the piston 44 moves in a downward direction under the force applied by fuel pressure within the chamber 54. As the fuel pressure in the first control chamber 48 is reduced, when the piston 44 abuts the stop member 50 it is caused to move away from the seating 51 by an amount equal to the clearance gap 49. Thus, the thrust member 42 is moved by a further amount in a downwards direction, thereby moving the enlarged region 18 of the valve needle 16 a further distance away from the seating 14. Movement of the enlarged region 18 away from the seating 14 by this further amount exposes the second outlet passages 26 and therefore fuel is also ejected from the second outlet passages 26. It will therefore be appreciated that the rate of fuel injection is increased.

In order to terminate injection, the control valve member 62 is moved downwardly such that it seats against the first valve seat 66 and the annular collar member 67 seats against the second valve seat 68. The pressure in the first and second control chambers 48,52, therefore equalises as fuel can no longer pass through the passages 71,70 and passage 76,74 respectively to low pressure. As the fuel pressures equalise in the first and second control chambers 48,52, the thrust member 42 moves in an upwards direction allowing the enlarged region 18 of the valve needle 16 to move into the seating 14. Fuel injection is therefore terminated.

It will be appreciated that by moving the control valve member 62 upwardly such that the annular collar member 67 moves away from the second seating 68 with the control valve member 62 already lifted away from the first seating 66, it is possible to move from a first fuel injection rate to a second fuel injection rate at a pre-selected time. The rate at which fuel is injected can therefore be controlled with greater accuracy than is possible with conventional piezoelectric actuators. As illustrated, appropriate shims 44*a*,50*a* or spacers may be used to set the distances through which the valve needle 16 is moved, in use.

In an alternative embodiment, a piezoelectric actuator may be used to control the control valve member 62 instead of an electromagnetic solenoid arrangement. The piezoelectric actuator may act directly on the control valve member 62 or may act on the control valve member 62 by means of a hydraulic control arrangement. The movements and forces required to move the control valve member 62 are relatively small compared to known fuel injectors using piezoelectric actuators. Therefore, although the use of a piezoelectric actuator increases the cost of the fuel injector, some advantage is still obtained. In the embodiment of the invention hereinbefore described, the fuel pressure within the first and second control chambers 48,52, is controlled by means of a common control valve arrangement. However, in an alternative embodiment of the invention, the fuel pressure in the second control chamber 52 may be controlled independently using a second control valve arrangement operated by a second electromagnetic actuator. Alternatively, fuel pressure in the second control chamber 52 may be controlled by an external pressure source, for example as described in UK patent application GB 9907565.7.

It will be appreciated that the valve needle may be provided with third and further outlet passages occupying different axial positions on the valve needle, with the fuel injector being adapted such that valve needle movement between third and further axial positions can be controlled . It will also be appreciated that the valve needle may take a different form. For example, fuel may be discharged from the fuel injector by passing through a narrow clearance defined between the bore 12 and the valve needle 16, the extent of movement of the valve needle 16 away from the seating 14 controlling the delivery rate of fuel or the fuel injection characteristics.

What is claimed is:

1. A fuel injector of the outwardly opening type comprising a nozzle body provided with a first bore, a valve needle slidable within the bore and engageable with a seating to control the supply of fuel from the bore, first and second control chambers for receiving fuel under pressure and a control valve arrangement for controlling the fuel pressure within the first and second control chambers, the valve needle being moveable in response to a change in fuel pressure in at least one of the first and second control chambers wherein the control valve arrangement includes a single control valve member having first and second valve seatings, whereby movement of the control valve member away from the first valve seating only causes movement of the valve needle into a first fuel injecting position and movement of the control valve member away from both the first and second valve seatings causes movement of the valve needle into a second fuel injecting position.

2. The fuel injector as claimed in claim 1, wherein the control valve arrangement is operable by means of an electromagnetic actuator arrangement.

3. The fuel injector as claimed in claim 1, wherein the control valve arrangement is operable by means of a piezoelectric actuator arrangement.

4. A fuel injector as claimed in claim 1, wherein the valve needle includes first and second fuel outlet passages axially spaced on the valve needle such that, when the valve needle is in the first fuel injecting position, fuel is only discharged through the first outlet passage and when the valve needle is in the second fuel injecting position fuel is also discharged through the second outlet passage.

5. The fuel injector as claimed in claim 1, wherein the control valve member has an annular collar member associated therewith, the annular collar member being engageable with the second valve seating, movement of the annular collar member away from the second valve seating being effected upon engagement between a step defined by the control valve member and the annular collar member.

6. The fuel injector as claimed in claim 5, wherein the control valve member carries a sleeve which defines the step.

7. The fuel injector as claimed in claim 4, wherein the first valve seating is defined by a further bore within which the control valve member is moveable, the second valve seating being defined by a separate seating member.

8. The fuel injector as claimed in claim 1, further comprising a thrust member, moveable in response to a change in fuel pressure in at least one of the first and second control chambers, the thrust member acting on the valve needle to control valve needle movement.

9. A fuel injector of the outwardly opening type comprising a nozzle body provided with a first bore, a valve needle slidable within the bore and engageable with a seating to control the supply of fuel from the bore, first and second control chambers for receiving fuel under pressure and a control valve arrangement for controlling the fuel pressure within the first and second control chambers, the valve needle being moveable in response to a change in fuel pressure in at least one of the first and second control chambers wherein the control valve arrangement includes two control valve members for controlling the fuel pressure within the first and second control chambers independently.

* * * * *